US005751314A

United States Patent [19]

Takemura et al.

[11] Patent Number: 5,751,314

[45] Date of Patent: May 12, 1998

[54] PRINT HEAD IN POWDER JET IMAGE FORMING APPARATUS HAVING A MATRIX ELECTRODE AND A GRID ELECTRODE

[75] Inventors: Osamu Takemura; Takahiko Kimura; Atsushi Fujii, all of Osaka, Japan

[73] Assignee: Mita Industrial Co., Ltd., Osaka, Japan

[21] Appl. No.: 336,218

[22] Filed: Nov. 7, 1994

[30] Foreign Application Priority Data

Nov. 11, 1993 [JP] Japan ..... 5-307282
Nov. 11, 1993 [JP] Japan ..... 5-307283

[51] Int. Cl.[6] ..... B41J 7/06

[52] U.S. Cl. ..... 347/55; 347/112

[58] Field of Search ..... 347/55, 111, 112, 347/120, 121, 123, 141, 147, 151; 355/261, 262

[56] References Cited

U.S. PATENT DOCUMENTS 4,563,613 1/1986 Genovese et al. ..... 313/497
5,153,611 10/1992 Kokado et al. ..... 347/55
5,202,704 4/1993 Iwao ..... 347/55

FOREIGN PATENT DOCUMENTS 1275160 11/1989 Japan ..... 347/123
531951 2/1993 Japan ..... 347/123

*Primary Examiner*—Benjamin R. Fuller
*Assistant Examiner*—Charlene Dickens
*Attorney, Agent, or Firm*—Beveridge, DeGrandi, Weilacher & Young, LLP

[57] ABSTRACT

In a print head for a powder jet image forming apparatus according to the present invention, a grid electrode is provided between first electrodes and a developer supply roller in parallel with major surfaces of an insulating layer, and therefore, a distance between any of the first electrodes and the grid electrode is kept fixed. Thus, applying a given level of voltage to the grid electrode allows an electric field for supplying developer to the first electrodes to arise uniformly. This is effective in avoiding uneven density in the resultant image.

10 Claims, 15 Drawing Sheets

PRINT HEAD IN POWDER JET IMAGE FORMING APPARATUS HAVING A MATRIX ELECTRODE AND A GRID ELECTRODE

BACKGROUND OF THE INVENTION

FIELD OF THE INVENTION

The applicant has developed a powder jet image forming apparatus as shown in FIG. 15. The powder jet image forming apparatus has a print head 2 which controls passage of toner electrostatically charged in specific polarity such as a negative polarity, a toner supply roller 1 for supplying the print head 2 with toner, a recording paper feed roller 3 for guiding recording paper P toward the print head 2, and a fusing roller 4 for fusing to the recording paper P the toner transferred onto the recording paper P in a previous stage.

As shown in FIG. 16, the print head 2 is comprised of an insulating substrate 20, frame elements 61 and 62 provided opposed to each other at fore and rear edges of the insulating substrate 20 in a recording paper feed direction (a direction of arrow A), a matrix electrode 40 formed in a rear half of the insulating substrate 20 in the context of the recording paper feed direction, and an ultrasonic oscillation generator 50 provided in a fore half of the insulating substrate 20 in the context of the recording paper feed direction.

As shown in FIGS. 17 and 18, the matrix electrode 40 includes a plurality of first electrodes 21 formed in a major surface of the insulating substrate 20 opposed to the toner supply roller 1 and a plurality of second electrodes 22 formed in a major surface of the insulating substrate 20 opposed to the recording paper feed roller 3. The first electrodes 21 and the second electrodes 22 are arranged in a matrix electrode. Toner holes 23 are formed extending through the print head 2 in intersections of the first electrodes 21 and the second electrodes 22 so as to pass toner therethrough.

ON voltage (e.g., −100V) and OFF voltage (e.g., +300V) are selectively applied to the first electrodes 21. ON voltage (e.g., 0V) and OFF voltage (e.g., −200V) are selectively applied. FIG. 4 depicts variation in applied voltages, "V1-0" through "V1-7", to the first electrodes 21. As shown in FIG. 4, the first electrodes 21 are under control of dynamic scan, and applied voltages to them are succeedingly turned on at intervals of given unit time. Only when ON voltage is applied to both the first electrodes 21 and the second electrodes 22, toner is passed through the toner holes 23 at the intersections of those electrodes, and consequently dot printing is performed. The recording paper P is sent by the recording feed roller 3 in a direction orthogonal to the first electrodes 21 and equivalent to a direction of the control of the first electrodes 21 by the dynamic scan (direction shown by arrow A in FIGS. 5 and 6). +500V voltage is applied to the recording paper feed roller 3. The toner supply roller 1 is grounded, and its surface potential is 0V.

The ultrasonic oscillation generator 50 causes ultrasonic oscillation upon the print head 2 to prevent the toner holes 23 from being stopped up with toner or to permit the toner to pass the toner holes 23 smoothly. The ultrasonic oscillation generator 50 consists of four ultrasonic oscillators 201, 202, 203 and 204. Oscillation frequency of the ultrasonic oscillators 201 to 204 is approximately in a range from 300 to 500 KHz, respectively.

Electric field (that which is for supplying toner) caused by potential difference between the toner supply roller 1 and the first electrodes 21 during the OFF voltage is applied thereto and brings it into effect supplying the print head 2 with the toner by the toner supply roller 1. However, since outer surface of the toner supply roller 1 is curved, the distance from the first electrodes 21 in the print head 2 to the outer surface of the toner supply roller 1 varies from one part to another. This causes the electric field for toner supply to be varied around the first electrodes 21. Thus, there arises the problem that the powder jet image forming apparatus produces an image which is uneven in density.

In the event that developer containing toner and carrier is used, there arises the problem that the carrier of ferrous fine particles entering the developer holes causes the first and second electrodes to short-circuit, or the problem that the carrier passing through the developer holes bumps the recording paper and scatters the toner on the recording paper.

When the ultrasonic oscillators 201 to 204 are used to cause oscillation of a certain frequency, sinusoidal wave arises. A way of generation of the sinusoidal wave will be discussed below. Assuming now that, as shown in FIG. 19, there lie two ultrasonic oscillation generators in two points, exiting points A and B, oscillations from the exiting points A and B are transmitted to a point C. If a section A-C and a section B-C are different in length from each other, the oscillations from the exciting points A and B are out of phase when they reach the point C, even if the oscillations in the exiting points A and B are in phase.

When a phase difference between two oscillations is 180 degrees as represented by oscillation A1 and oscillation B2 in FIG. 20, the oscillations cancel with each other as represented by oscillation (A1+B2) in FIG. 20. In this case, a node of the sinusoidal wave corresponds to the point C. When the phase difference at point C between the oscillations from the exciting points A and B is 0 degree (in phase) as represented by oscillation A1 and oscillation B2 in FIG. 20, the oscillations are reinforced by each other as represented by oscillation (A1+B1) in FIG. 20. Thus, in this case, a loop of the sinusoidal wave corresponds to the point C.

In the print head 2, practically not two but a greater variety of oscillations including a reflected wave at an end surface of the print head 2 are composed to generate a sinusoidal wave.

As has been described, when the ultrasonic oscillators 201 to 204 cause a sinusoidal wave in the print head 2, some part of the matrix electrode 40 in the print head 2 is stronger in oscillation than the other. Although the toner is supplied smoothly under control in part of strong oscillation, control of the toner is lost in part of weak oscillation. Eventually, there often arises the problem that density of an image is degraded in the part of weak oscillation, or the worst of all, the toner cannot be passed through the toner holes.

SUMMARY OF THE INVENTION

An object of the present invention is to provide a print head for a powder jet image forming apparatus in which variation in electric field for supplying developer throughout the first electrodes caused by variation in distance from first electrodes to the outer surface a toner supply roller can be avoided, and consequently unevenness in density the of an image can be avoided. Another object of the present invention is to provide a print head for a powder jet image forming apparatus in which first and second electrodes are no longer short-circuited by carrier of ferrous fine particles entering developer holes, and carrier passing through the developer holes no longer bumps recording paper and scatters toner on the recording paper.

Still another object of the present invention is to provide a powder jet image forming apparatus in which oscillation in and around all developer holes in a print head can be made uniform, and developer in the developer holes can be well brought under control.

A print head in a powder jet image forming apparatus of the present invention has a plurality of first electrodes formed in a major surface of an insulating layer close to a developer supply roller, and a plurality of second electrodes formed in another major surface of the insulating layer close to a recording paper feed element. The first electrodes and the second electrodes together constitute a matrix electrode, and holes for passing developer therethrough are formed at intersections of the first and second electrodes. The print head further includes a grid electrode provided between the first electrodes and the developer supply roller in parallel with the surfaces of the insulating layer, and the grid electrode has a plurality of apertures and a plurality of bridge electrodes. The grid electrode may be shaped in checkers or may have a column of slits in parallel with one another. Preferably, the grid electrode has the bridge electrodes positioned opposed to the holes for passing developer.

In the event that the developer is a two-component developer containing carrier and toner, the apertures in the grid electrode are preferably formed so as to pass the toner therethrough but not the carrier. In the event that the apertures in the grid electrode are shaped in slits extending in a given direction, the slits have a width larger than a diameter of particles of the toner and smaller than a diameter of particles of the carrier.

Preferably, a ratio of the total area of all the apertures to an area of a region where the apertures are formed in the grid electrode ranges from 30% to 70%.

The grid electrode is fabricated in a procedure as follows: first, a metal plate is etched from its opposite sides to form a plurality of slits of a specified width (step 1). Next, a metal layer is formed over the entire surface of the metal plate with the slits by means of electrolytic plating or electroless plating (step 2). Thus, the slits formed in the step 1 are narrowed in width to be minute slits in the grid electrode.

The grid electrode may be fabricated in another procedure as follows: First, a metal plate is etched from one side to form a plurality of slits of a specified width (step 1). Next, after the metal plate with the slits is mounted on and adhered to a non-metal plate, a metal layer is formed over the entire surface of the metal plate with the slits by means of electrolytic plating or electroless plating (step 2). Then, the non-metal plate is removed from the metal plate where the metal layer is formed in the previous step (step 3). Thus, the slits formed in the step 1 are narrowed in width to be minute slits in the grid electrode. In the print head for the powder jet image forming apparatus of the present invention, since the grid electrode is provided between the first electrodes and the developer supply roller in parallel with the major surfaces of the insulating layer, distance between the first electrodes and the grid electrode is kept fixed in any part. Thus, applying a specified level of voltage to the grid electrode allows an electric field for supplying developer to the first electrodes to arise uniformly between the first electrodes and the grid electrode. This is effective in avoiding uneven density in a resultant image.

In the event that the apertures in the grid electrode is shaped and sized so as to pass the toner therethrough but not the carrier, the carrier can be prevented from entering the holes for passing developer in the print head. Thus, the first and second electrodes are no longer shortcircuited by the carrier entering the holes for passing developer carrier passing through the holes is prevented from bumping recording paper and scattering the toner on the recording paper.

A powder jet image forming apparatus in an aspect of the present invention includes a print head which has a plurality of first electrodes and a plurality of second electrodes arranged in matrix, with an insulating layer interposed therebetween, and which has holes for passing developer therethrough at intersections of the first and second electrodes, and an ultrasonic oscillation generator provided in the print head for causing ultrasonic oscillation in the print head. The ultrasonic oscillation generator includes a plurality of ultrasonic oscillators, and the ultrasonic oscillators are classified into two or more groups. The ultrasonic oscillators are driven in a predetermined order of the groups succeedingly from one group to another.

In this powder jet image forming apparatus, the ultrasonic oscillation generator consists of the ultrasonic oscillators classified into two or more groups. Since they are driven in a predetermined order of the groups succeedingly from one group to another, sinusoidal wave varies every specified period of time. Thus, oscillation in every part of the print head becomes increasingly uniform, compared with the prior art embodiments, and the toner in and around the holes for passing developer can be well brought under control.

A powder jet image forming apparatus in another aspect of the present invention includes a print head which has a plurality of first electrodes and a plurality of second electrodes arranged in matrix, with an insulating layer interposed therebetween, and which has holes for passing developer therethrough at intersections of the first and second electrodes, and an ultrasonic oscillation generator provided in the print head for causing ultrasonic oscillation in the print head. The ultrasonic oscillation generator includes a plurality of ultrasonic oscillators, and the ultrasonic oscillators are classified into two or more groups. Moreover, the ultrasonic oscillators are driven under control in such a manner that a phase difference in drive voltage of one group of the ultrasonic oscillators from the other varies every specified period of time.

In this powder jet image forming apparatus, the ultrasonic oscillation generator consists of the ultrasonic oscillators classified into two or more groups. Since they are driven so that the phase difference in the drive voltage between the groups of the ultrasonic oscillators varies every specified period of time, the sinusoidal wave varies as time elapses. Thus, oscillation in every part of the print head becomes increasingly uniform, compared with the prior art embodiments, and eventually, the toner in and around the holes for passing developer can be well brought under control.

A powder jet image forming apparatus in further another aspect of the present invention includes a print head which has a plurality of first electrodes and a plurality of second electrodes arranged in matrix, with an insulating layer interposed therebetween, and which has holes for passing developer therethrough at intersections of the first and second electrodes, and an ultrasonic oscillation generator provided in the print head for causing ultrasonic oscillation in the print head. The ultrasonic oscillation generator includes a plurality of ultrasonic oscillators, and the ultrasonic oscillators include two or more ultrasonic oscillators having different resonance frequencies. The ultrasonic oscillators are oscillated at their respective resonance frequencies by applying, to the ultrasonic oscillators, voltages of frequencies corresponding to their respective resonance frequencies.

In this powder jet image forming apparatus, the ultrasonic oscillation generator consists of the ultrasonic oscillators which include two or more ultrasonic oscillators different in resonance frequency from one another. They are oscillated at their respective resonance frequencies by applying voltages of frequencies corresponding to their respective resonance frequencies.

Wavelengths of oscillations generated by the ultrasonic oscillators different in resonance frequency from each other are not the same with each other, and when the oscillations from the ultrasonic oscillators different in resonance frequency are transmitted to an arbitrary point on the print head, a combination of phases of the oscillations of those ultrasonic oscillators having different resonance frequencies are not always kept fixed, that is, a magnitude of oscillation in the arbitrary point on the print head is varied. Thus, oscillation in every part of the print head becomes increasingly uniform, compared with the prior art embodiments, and the toner in and around the holes for passing developer can be well brought under control.

A powder jet image forming apparatus in still another aspect of the present invention includes a print head which has a plurality of first electrodes and a plurality of second electrodes arranged in matrix, with an insulating layer interposed therebetween, and which has holes for passing developer therethrough at intersections of the first and second electrodes, and an ultrasonic oscillation generator provided in the print head for causing ultrasonic oscillation in the print head. The ultrasonic oscillation generator includes a plurality of ultrasonic oscillators, and the ultrasonic oscillators include two or more ultrasonic oscillators having different resonance frequencies. The ultrasonic oscillators are oscillated at their respective resonance frequencies by applying the same pulse voltage to them.

In this powder jet image forming apparatus, the ultrasonic oscillation generator consists of the ultrasonic oscillators including two or more ultrasonic oscillators different in resonance frequency from each other. Applying the same pulse voltage to the ultrasonic oscillators, they are oscillated at their respective resonance frequencies.

Wavelengths of oscillations generated by the ultrasonic oscillators different in resonance frequency from each other are not the same as each other, and when the oscillations from the ultrasonic oscillators different in resonance frequency are transmitted to an arbitrary point on the print head, a combination of phases of the oscillations from those ultrasonic oscillators having different resonance frequencies are not always kept fixed, that is, a magnitude of oscillation in the arbitrary point on the print head is varied. Thus, oscillation in every part of the print head becomes increasingly uniform, compared with the prior art embodiments, and the toner in and around the holes for passing developer can be well brought under control.

DETAILED DESCRIPTION OF THE PREFERRED EMBODIMENT

With reference to FIG. 1 through FIG. 14, preferred embodiments of the present invention will be described.

(1) Embodiment 1

First, with reference to FIGS. 1 to 11, a first preferred embodiment of the present invention will be described.

Figure 1:
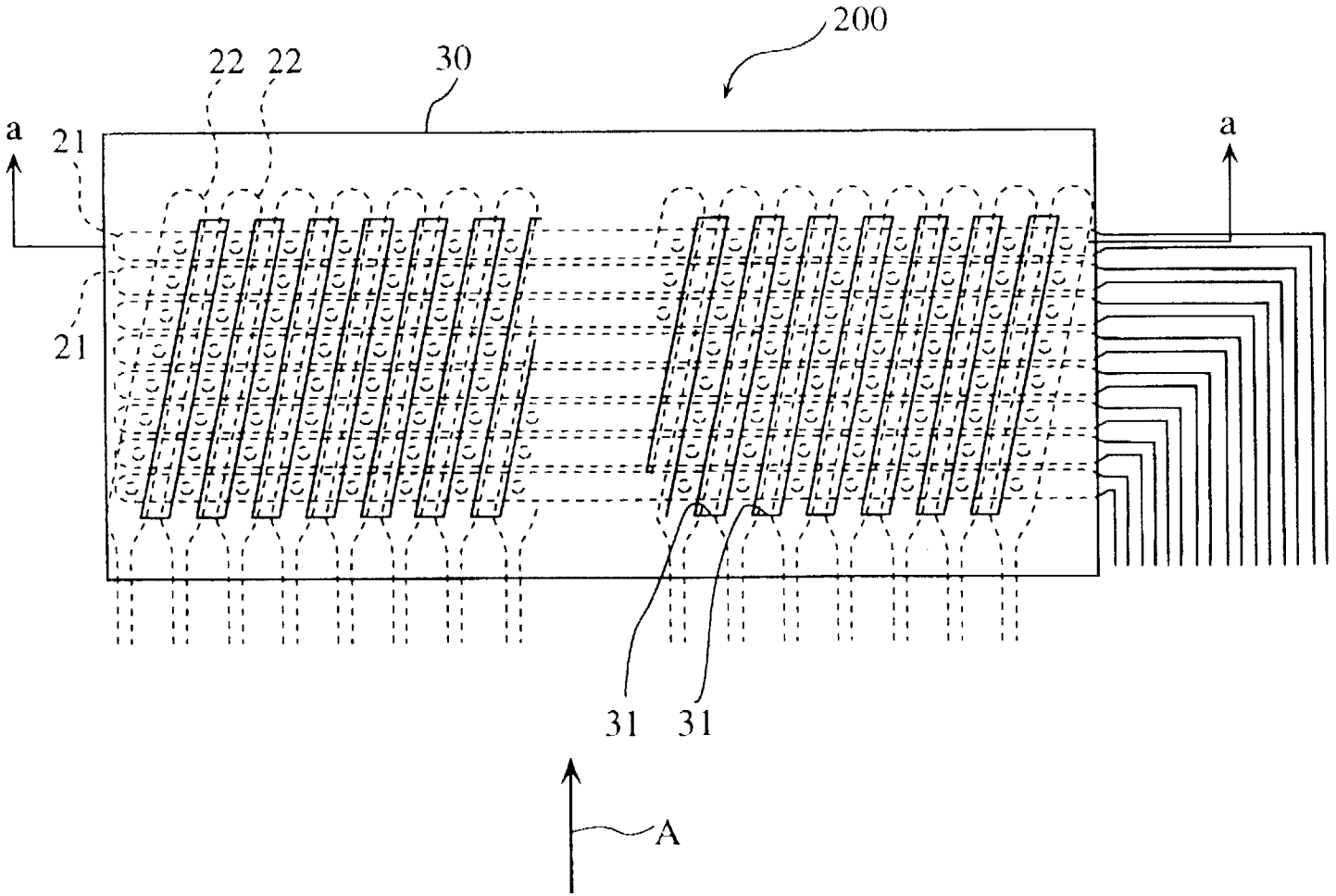
FIG. 1 is a plan view showing a print head.
Figure 2:
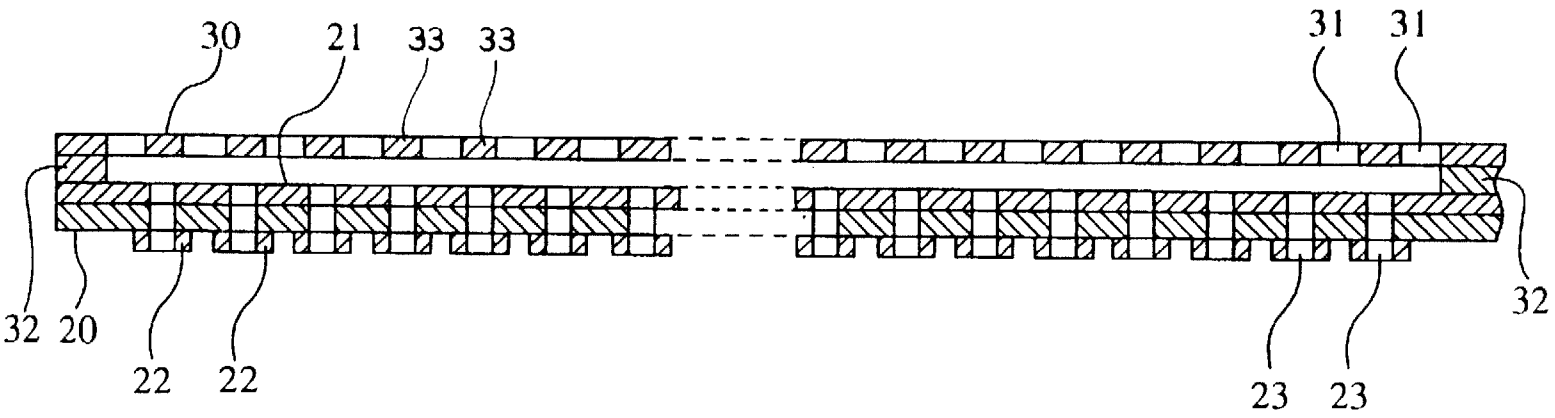
FIG. 2 is a sectional view taken along the line a—a of FIG. 1.

FIG. 1 and FIG. 2 depict a print head 200. In FIGS. 1 and 2 and FIGS. 17 and 18, like reference numerals denote corresponding components.

Developer used herein is a type of two components, toner and carrier. In this embodiment, it is assumed that the toner is electrostatically charged in a negative polarity.

Similar to the prior art print head 2 (see FIG. 17), the print head 200 includes an insulating substrate 20, a plurality of first electrodes 21 formed in a major surface of the insulating substrate 20 close to a toner supply roller 1, and a plurality of second electrodes 22 formed in another major surface of the insulating substrate 20 close to a recording paper feed roller 3. The first electrodes 21 and the second electrodes 22 are arranged in a matrix electrode. Toner holes 23 extending through the print head 2 are formed at intersections of the first electrodes 21 and the second electrodes 22.

Figure 4:
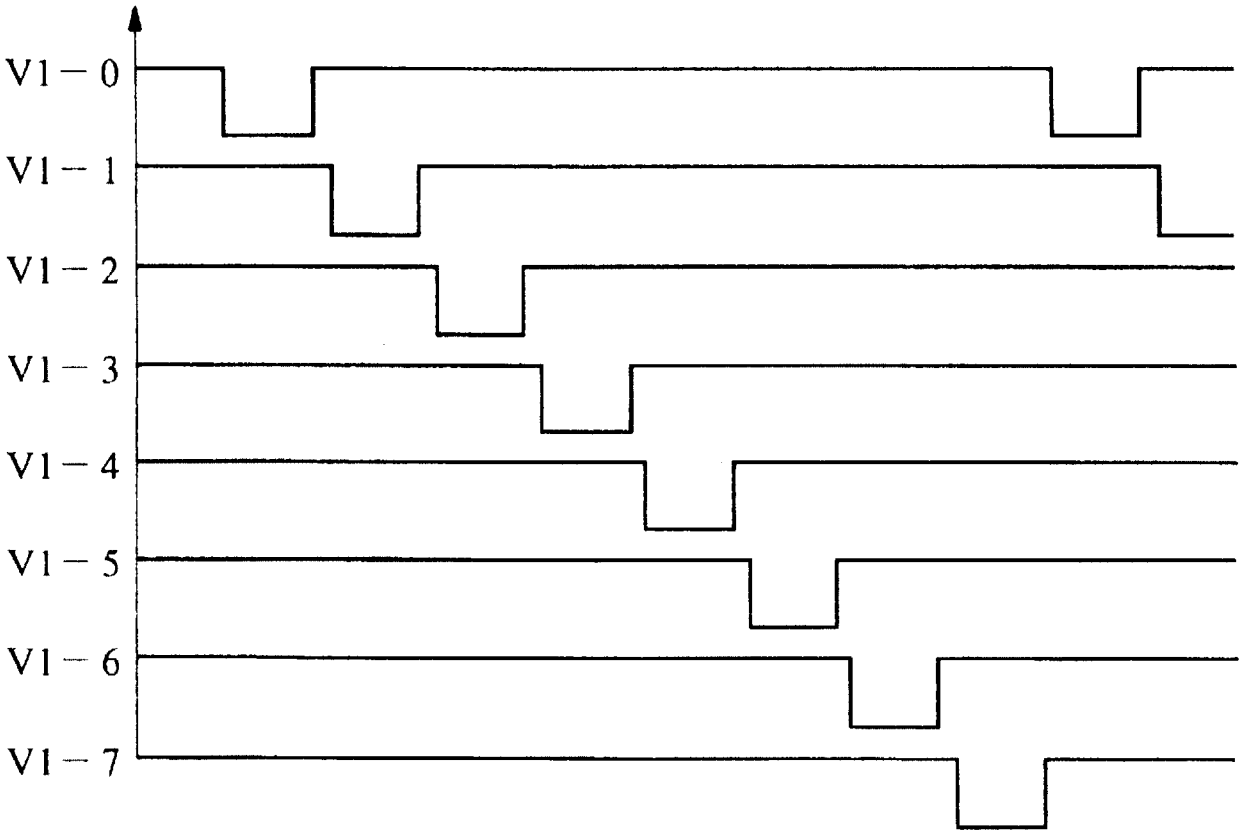
FIG. 4 is a time chart illustrating variations in applied voltage to first electrodes.

ON voltage (e.g., −100V) and OFF voltage (e.g., +300V) are selectively applied to the first electrodes 21 while ON voltage (e.g., 0V) and OFF voltage (e.g., −200V) are selectively applied to the second electrodes 22. FIG. 4 illustrates variation in voltages, "V1-0" through "V1-7", applied to the first electrodes 21. As shown in FIG. 4, the first electrodes 21 are under control of dynamic scan, and the applied voltages are succeedingly turned on at intervals of, given unit time. Only when the ON voltage is applied to both the first electrodes 21 and the second electrodes 22, the toner is passed through the toner holes 23 at the intersections of those electrodes, and consequently dot printing is performed.

Figure 21:
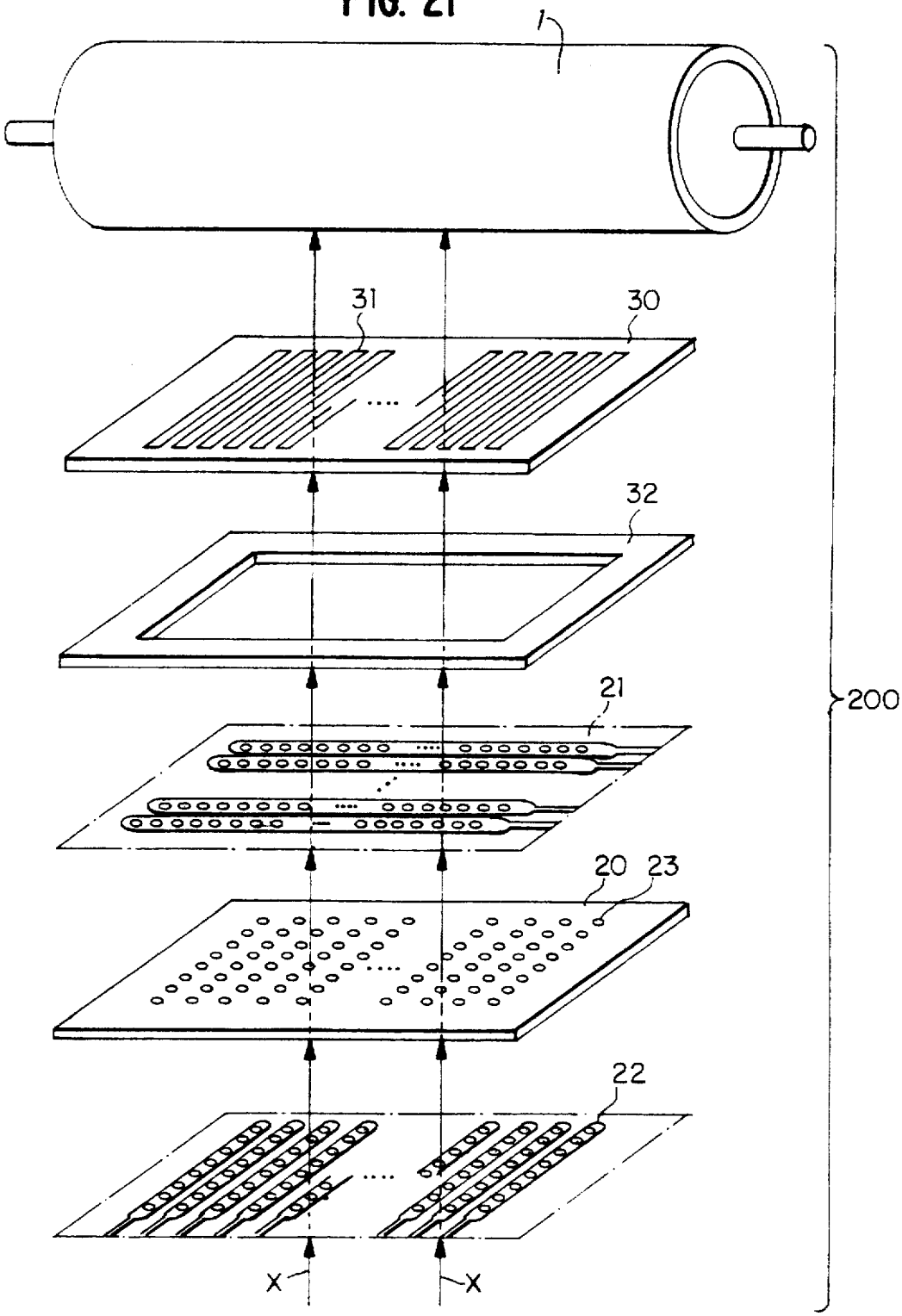
FIG. 21 is an exploded view, in perspective, of the print head of FIG. 1.

Unlike the prior art print head 2, the print head 200 is provided with a grid electrode 30 shaped in rectangular plate between the first electrodes 21 and the toner supply roller 1 and in parallel with the surface of the insulating substrate 20, as shown in FIG. 1, and FIG. 2, and FIG. 21. The grid electrode 30 shaped in rectangular plate has slits 31 formed in parallel with the second electrodes 22 in positions corresponding to gaps between adjacent ones of the second electrodes 22 in the major surface of the insulating substrate 20 close to the toner supply roller 1. Bridge electrodes 33 of the grid electrode 30 are arranged in positions opposed to the toner holes 23.

As shown in FIG. 21, the print head includes a plurality of unobstructed paths X which pass through the holes and apertures of the print head.

Spacers 32 extending in the recording paper feed direction (direction shown by arrow A in FIG. 1) lies over left and right ends of all the first electrodes 21, and opposite ends of the grid electrode 30 is mounted on and fixed to both the spacers 32. A thickness of the grid electrode 30 is preferably in a range approximately from 0.05 to 2.00 mm.

The grid electrode 30, if thinner than the range from 0.05 to 2.00 mm, is insufficient in rigidity while it is poor in processability, if thicker than the range. A distance between the first electrodes 21 and the grid electrode 30 ranges approximately from 0.2 to 1.5 mm. A ratio of the total area of all the slits to an area of a region where the slits are formed in the grid electrode 30 ranges from 30% to 70%.

A width of the slits 31 formed in the grid electrode 30 is larger than a diameter of particles of the toner of the two-component developer and smaller than a diameter of particles of the carrier. Assuming now that the diameters (center diameters) of the particles of the toner and the carrier of the two-component developer used in the power jet image forming apparatus are respectively about 10μm and 50 μm, the width of the slits 31 in the grid electrode 30 is 30μm.

For example, voltage larger than the potential at the toner supply roller 1 and smaller than the OFF voltage (+300V) to the first electrodes 21 is applied to the grid electrode 30. Applied voltage to the grid electrode 30 is preferable in a range from +100V to +200V.

In the powder jet image forming apparatus with the print head 200 as mentioned above, a potential difference between the toner supply roller 1 and the grid electrode 30 causes a first electric field for toner supply between the toner supply roller 1 and the grid electrode 30. A potential difference between the grid electrode 30 and the first electrodes 21 during the OFF voltage is applied thereto causes a second electric field for toner supply between the grid electrode 30 and the first electrodes 21.

The first electric field works to supply toner from the toner supply roller 1 to the grid electrode 30. The second electric field works to supply the toner from the grid electrode 3 to the first electrodes 21. A potential difference between the first electrodes 21 and the second electrodes 22 upon applying the ON voltage to the first electrodes 21 and the second electrodes 22 allows the toner supplied to the first electrodes 21 to be passed through the toner holes 23 and then transferred onto the recording paper.

Figure 3:
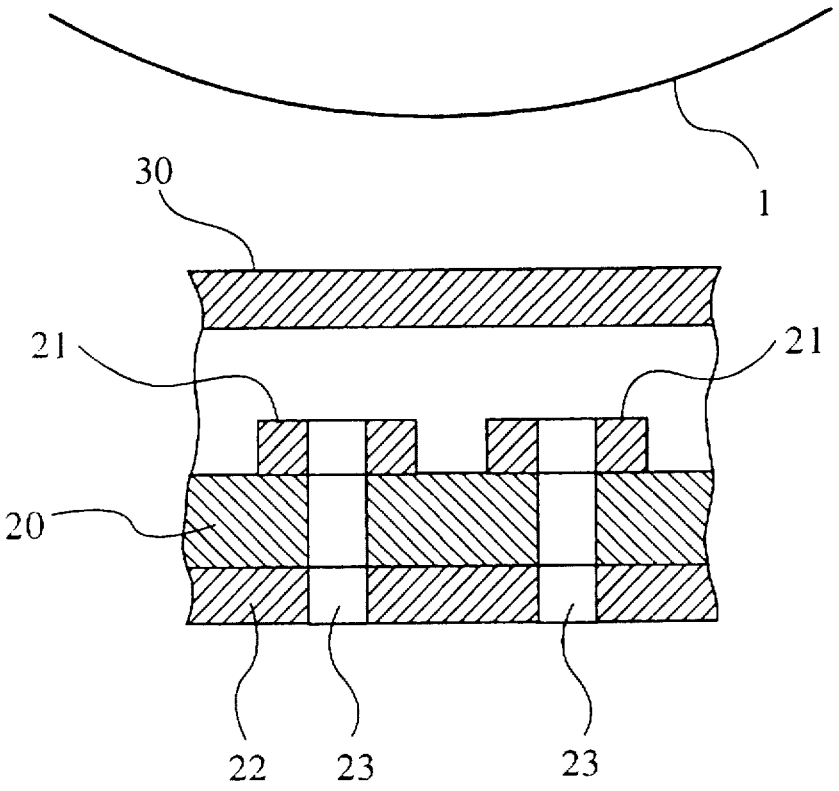
FIG. 3 is a partial enlarged sectional view illustrating a relation between a toner supply roller and the print head.

As shown in FIG. 3, the distance between the first electrodes 21 and the grid electrode 30 keeps uniform in the print head 200. Hence, applying a specified level of voltage to the grid electrode 30 permits the electric field for supplying toner to the first electrodes to arise uniformly thoroughly between the first electrodes 21 and the grid electrode 30. Consequently, an image can be produced without unevenness in density.

Since the width of the slits 31 formed in the grid electrode 30 is larger than the diameter of the particles of the toner of the two-component developer and smaller than the diameter of the particles of the carrier of the developer, the carrier no longer goes through the toner holes 23 in the print head. Thus, short-circuit between the first electrodes 21 and the second electrodes 22 caused by the carrier in the toner holes 23 can be avoided, and the carrier passed through the toner holes 23 is prevented from bumping the recording paper to scatter the toner around on the recording paper.

In the above embodiment, the bridge electrodes over the slits 31 in the grid electrode 30 are arranged in positions opposed to the toner holes 23, as shown in FIG. 2. Thus, the toner passed through the slits 31 in the grid electrode 30 is supplied to part of the first electrodes 21 other than the toner holes 23. Because of alternation in the electric field between the first electrodes 21 and the grid electrode 30 and diffusion of the toner by ultrasonic oscillation based upon the dynamic scan of the first electrodes 21, the toner supplied to the part of the first electrodes 21 other than the toner holes 23 is gathered in and around the toner holes 23, so as to let that the toner pass through the toner holes 23 when it is needed for printing.

Since the bridge electrodes over the slits 31 in the grid electrode 30 are positioned opposed to the toner holes 23, the bridge electrodes block the toner so as not to directly pass through the slits 31 to the toner holes 23. Hence, the toner no longer pass through the toner holes 23 when passage of the toner therethrough is not permitted, and this is effective to avoid fogging in the resultant image.

The ratio (referred to as "slit opening ratio" hereinafter) of the total area of the slits 31 to the area of the region where the slits 31 are formed in the grid electrode 30 ranges from 30% to 70% for the following reason: When the slit opening ratio is less than 30%, an amount of the toner supplied by the toner supply roller 1 through the slits 31 to the first electrodes 21 is undesirably insufficient to attain a satisfactory level of printing density. Meanwhile, when the slit opening ratio is more than 70%, the remaining region occupied by the bridge electrodes is accordingly reduced. Thus, the grid electrode 30 becomes less effective in retaining the electric field uniform between the first electrodes 21 and the grid electrode 30, and fogging still arises in the resultant image.

While the grid electrode is configured so that it has parallel slits in the above-mentioned embodiment, that which is shaped like checkers having a plurality of rectangular apertures defined therein. A method of fabricating the grid electrode 30 from thin plate of metal like stainless of 20μm to 50μm in thickness to finally have the slits 31 of 30μm in width will be explained below. There are two ways of this method.

(i) Method 1

Figure 5:
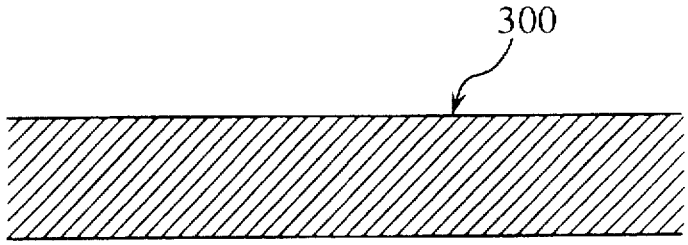
FIG. 5 through FIG. 7 are step diagrams showing a method of fabricating a grid electrode.
Figure 6:
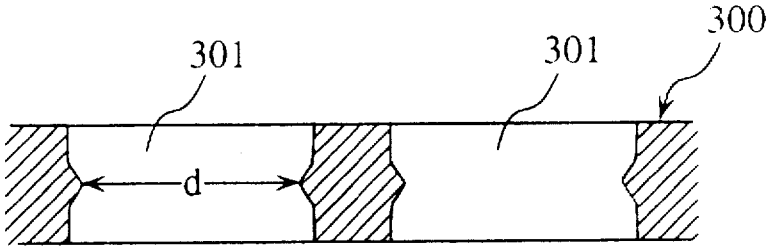
Figure 7:
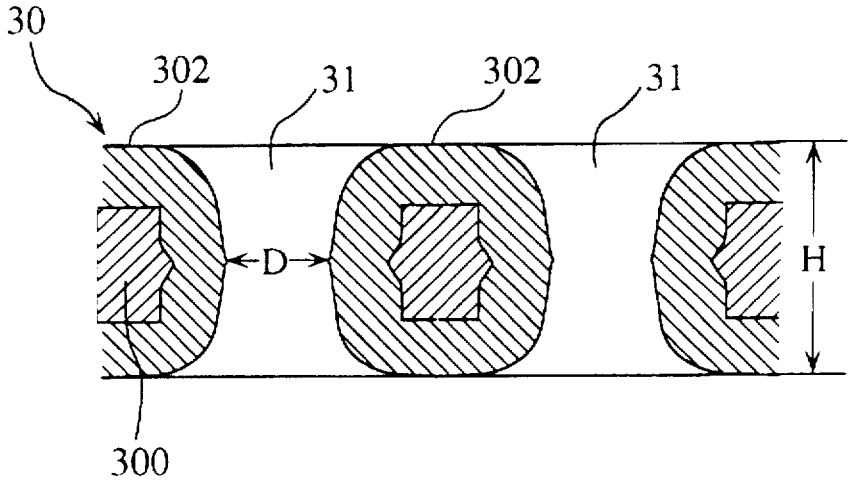

FIG. 5 through FIG. 7 illustrate a first exemplary method.

A thin plate 300 of metal like stainless of 20μm to 50 μm in thickness as shown in FIG. 5 is first etched from its opposite sides to form slits 301 having a width "d" in a range approximately from 50μm to 100μm, as shown in FIG. 6.

Then, a metal layer 302 of Ni or the like is formed over the entire surface of the plate 300 with the slits 301 by means of electroless plating. Thus, the slits 301 are narrowed into the slits 31 having a width "D" of 30μm, as shown in FIG. 7.

More specific example of this method will be explained with reference to FIGS. 5 to 7.

A stainless plate (SUS304) 300 of 30μm in thickness is first subjected to chemical etching from its opposite sides to form slits 301 having a width "d" of 70μm. Then, a Ni layer 102 of 20μm thickness is formed over the entire surface of the stainless plate 300 with the slits 301 by means of electroless plating. In this way, the grid electrode 30 of 30μm slid width "D" and 70μm thickness "H" can be obtained. In this embodiment, a width of an upper opening of the slits 31 from which the toner is supplied is larger than a minimum width of the slits 31, and therefore, the toner supplied to the first electrodes 21 is greater in amount.

(ii) Method 2

FIG. 8 through FIG. 11 illustrate another exemplary method.

Figure 8:
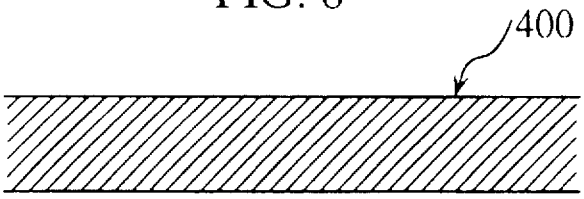
FIG. 8 through FIG. 11 are step diagrams showing another method of fabricating the grid electrode.
Figure 9:
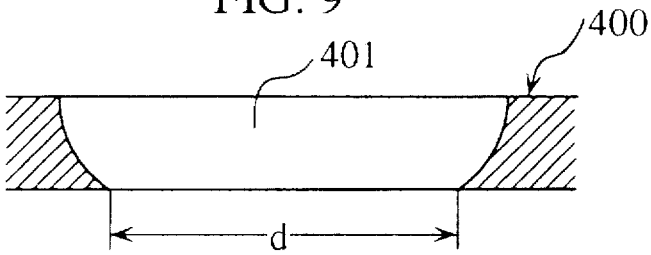
Figure 10:
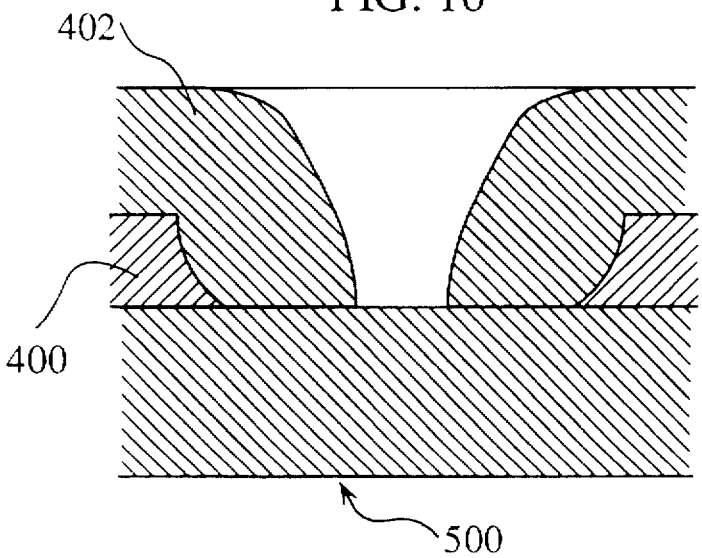

First a thin plate 400 of metal like stainless or the like of 20μm to 50μm thickness as shown in FIG. 8 is etched from its upper surface to form slits 401 having a width "d" in a range approximately from 80μm to 130μm, as shown in FIG. 9. Then, after the metal thin plate 400 with the slits 401 is mounted on and adhered to a non-metal plate 500 of glass or the like, a metal layer 402 of Ni or the like is formed over surface of the metal thin plate 400 on the non-metal plate 500 by means of electroless plating, as shown in FIG. 10.

Figure 11:
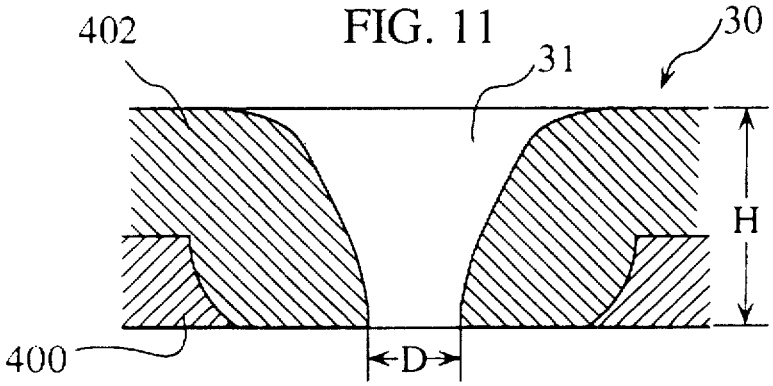

After that, the non-metal plate 500 is removed from the metal thin plate 400. Thus, the grid electrode 30 having the slits 31 of 30μm slit width "d", as shown in FIG. 11.

A more specific example of this method will be explained with reference to FIGS. 8 to 11.

First, the stainless plate (SUS 304) 400 of 30μm thickness is subjected to chemical etching from its upper surface to form the slits 401 having a width "d" of 110μm. Then, the stainless plate 400 with the slits 401 is mounted on the glass plate 500 and fixed thereto by epoxy adhesive. Next a Ni layer 402 is formed in 40μm thickness over surface of the stainless plate 400 on the glass plate 500 by means of electroless plating.

After that, the glass plate 500 is removed from the stainless plate 400. Thus, the grid electrode 30 having the slits 31 of 30μm width "D" and 70μm thickness "H" can be obtained. In this embodiment, since the slits 31 are 110μm width in their upper openings from which the toner is supplied while their minimum width is 30μm, the toner supplied to the first electrodes 21 is greater in amount.

(2) Embodiment 2

Another embodiment of the present invention will now be described with reference to FIG. 12.

Figure 12:
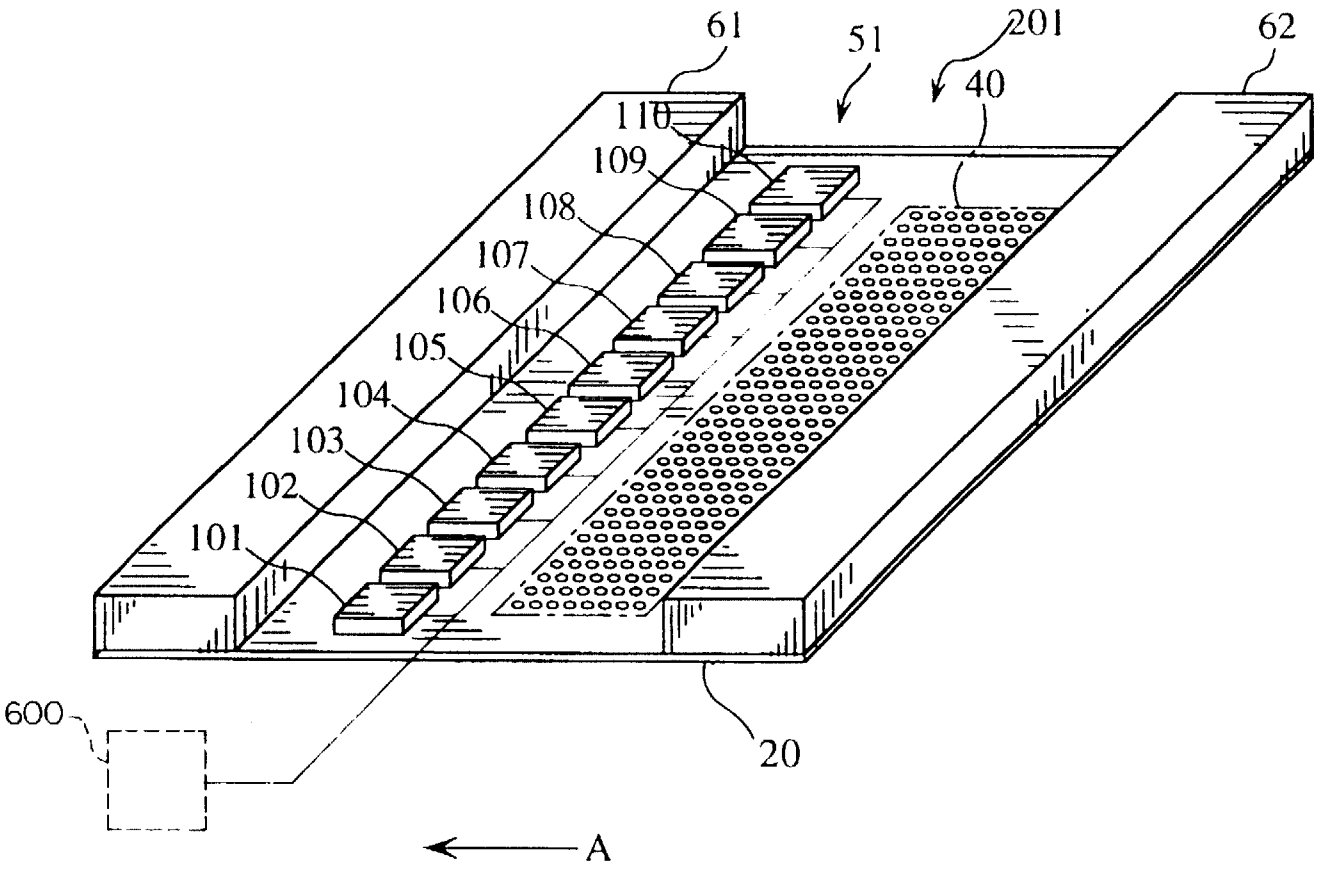
FIG. 12 is a schematic perspective view showing another print head.
Figure 16:
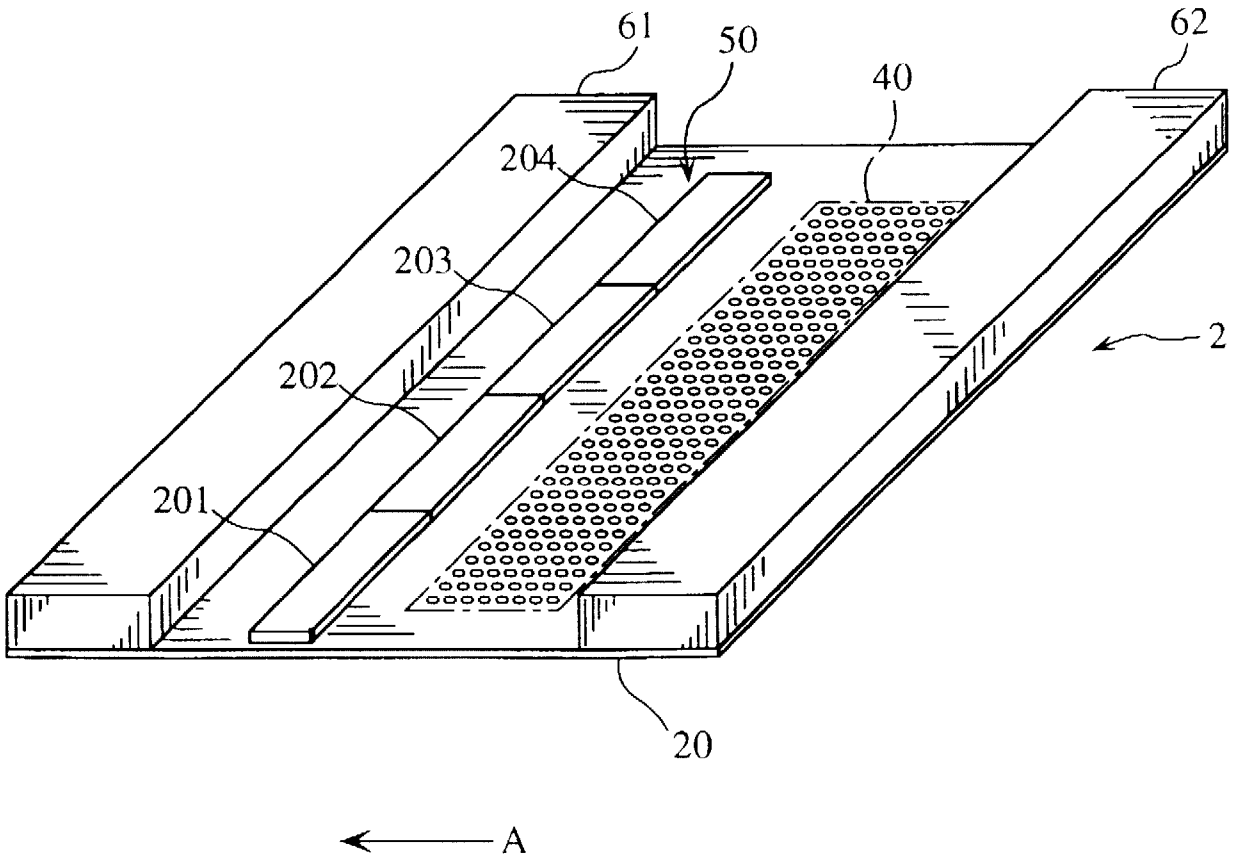
FIG. 16 (PRIOR ART)
FIG. 16 is a schematic perspective view showing a prior art print head.
Figure 17:
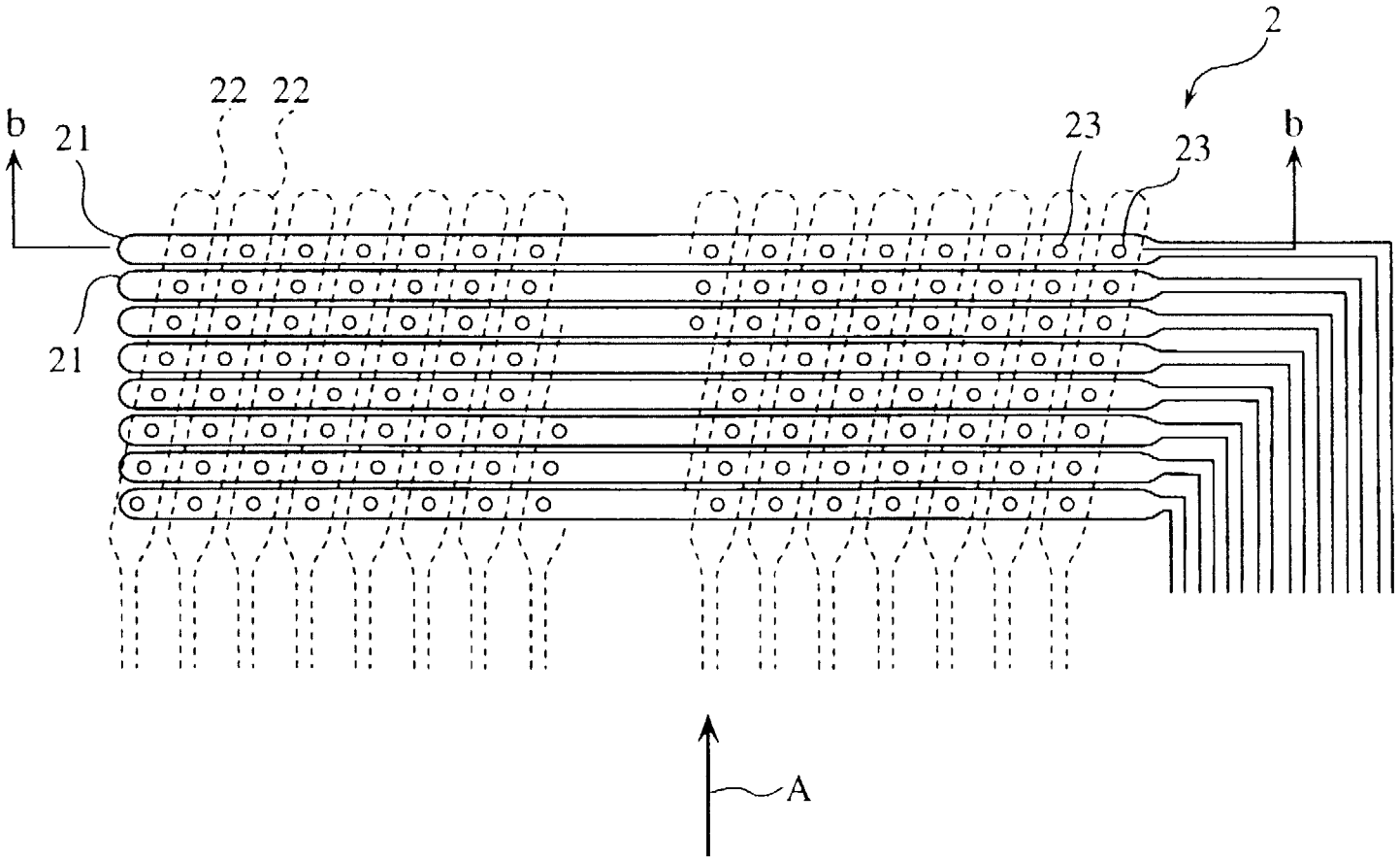
FIG. 17 (PRIOR ART)
FIG. 17 is a plan view showing a matrix electrode of FIG. 16.
Figure 18:
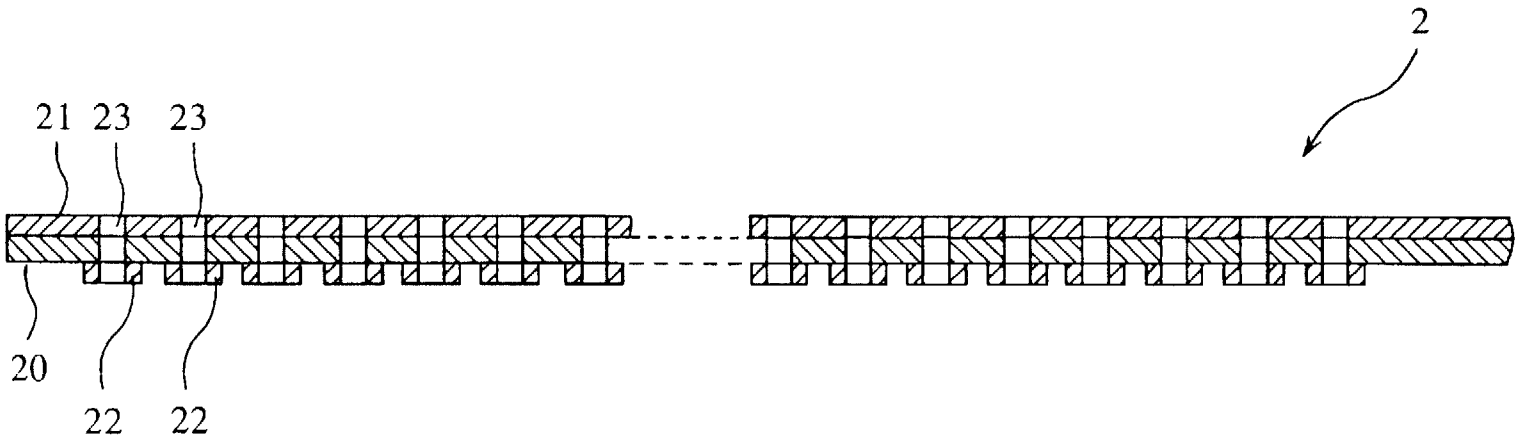
FIG. 18 (PRIOR ART)
FIG. 18 is a sectional view taken along the line b—b of FIG. 17.
Figure 19:
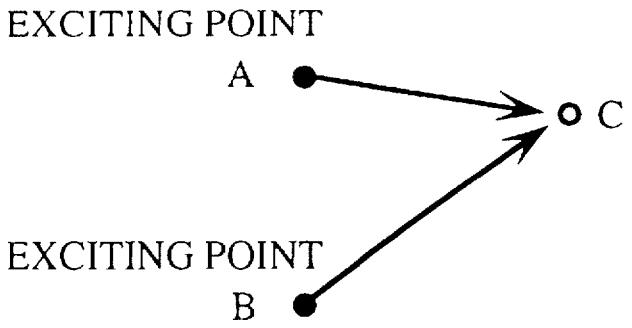
FIG. 19 is a diagram illustrating a mechanism of a standing wave.
Figure 20:
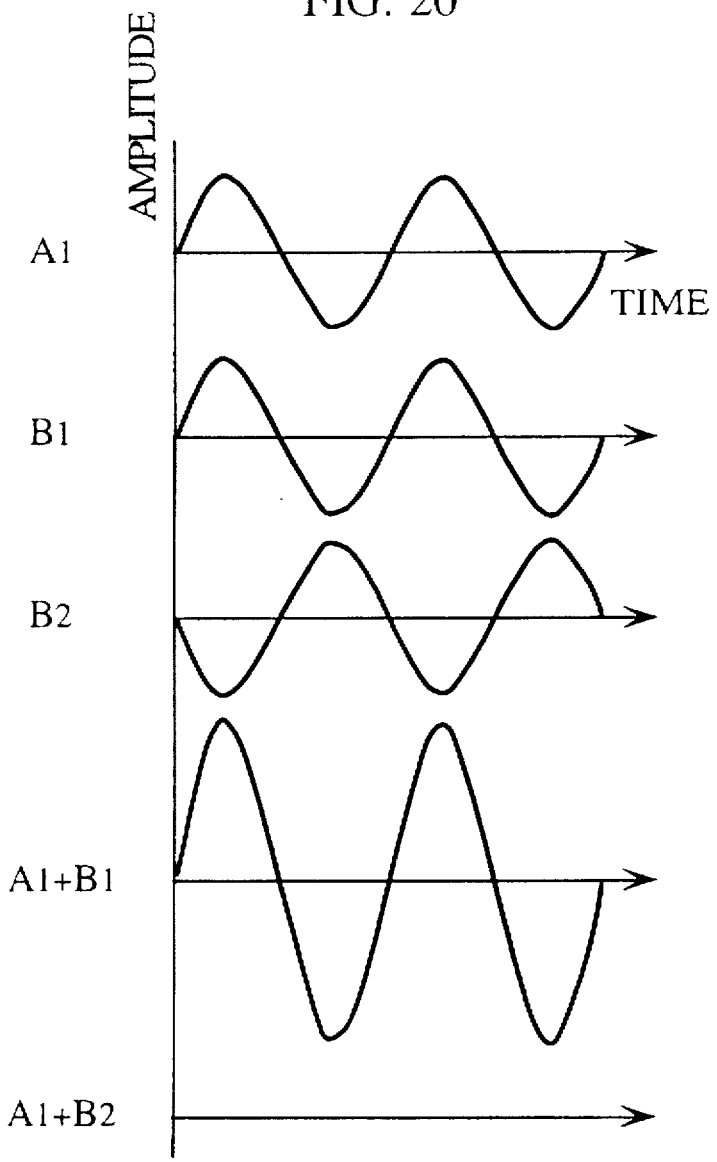
FIG. 20 is a diagram illustrating the mechanism of standing wave.

FIG. 12 depicts a print head 201. In FIG. 12 and FIG. 16, like reference numerals denote corresponding parts, and explanation about them is omitted.

In the print head 201, an ultrasonic oscillation generator 51 consists of a plurality of ultrasonic oscillators, 101 to 110, arranged in alignment and a controller 600 therefore. The odd-numbered ultrasonic oscillators, 101, 103, 105, 107 and 109, are classified into a first group while the even-numbered ultrasonic oscillators, 102, 104, 106, 108 and 110, are classified into a second group. The ultrasonic oscillators 101 to 110 are driven under control as mentioned below.

The first group of the ultrasonic oscillators, 101, 103, 105, 107 and 109, and the second group of the ultrasonic oscillators, 102, 104, 106, 108 and 110, are alternately driven at intervals of a given period of time. Specifically, sinusoidal wave a.c. voltage is applied alternately to the first group of the ultrasonic oscillators and the second group of the ultrasonic oscillators. Assuming now that a period of time for passing the toner through the toner holes 23 at one dot output ranges approximately from 300μs to 800μs, time intervals for shift in driving the ultrasonic oscillators from one of the groups to the other may be, for example, set to a range approximately from 10μs to 100μs. In this way, alternately driving the first group of the ultrasonic oscillators, 101, 103, 105, 107 and 109, and the second group of the ultrasonic oscillators, 102, 104, 106, 108 and 110, at intervals of the given period of time, sinusoidal wave is shifted every given period of time from one generated by the first group of the ultrasonic oscillators to the one generated by the second group of the ultrasonic oscillators. Thus, since the sinusoidal wave varies every given period of time, oscillation in every part of the matrix electrode 40 is increasingly uniformed. This results in the toner in and around the toner holes 23 being well brought under control.

(3) Embodiment 3

A further another embodiment of the present invention will now be described with reference to FIG. 12. A configuration of a print head 201 is equivalent to that described in the Embodiment 2, and therefore, explanation about it is omitted.

Odd-numbered ultrasonic oscillators, 101, 103, 105, 107 and 109, are classified into a first group while evennumbered ultrasonic oscillators, 102, 104, 106, 108 and 110, are classified into a second group. The ultrasonic oscillators 101 to 110 are driven under control as mentioned below. In this embodiment, one of the groups of the ultrasonic oscillators are always driven while the other group are intermittently driven, and thereby, phase difference between oscillations generated by both the groups of the ultrasonic oscillators is succeedingly changed. The oscillations generated by both the groups of the ultrasonic oscillators are equivalent in frequency. This embodiment is more specifically characterized as follows. The first group of the ultrasonic oscillators are always driven. The second group of the ultrasonic oscillators are interrupted for a given period of time after driven for a given period of time. The period of interruption is set to a value sufficient to make the oscillations generated by the first and second groups of the ultrasonic oscillators out of phase to each other by a value other than 360 degrees, for example, 26 degrees. Assuming now that a period of time for passing the toner through the toner holes 23 at one dot output ranges approximately from 300μs to 800 μs, a period of time for once driving the second group of the ultrasonic oscillators is set to a period shorter than the range, for example, a period ranging approximately from 10 μs to 100μs.

In the event that the period of interruption is set to a value sufficient to make the oscillations generated by the first and second groups of the ultrasonic oscillators out of phase from each other by 26 degrees, the phase difference between the oscillations generated by both the groups of the ultrasonic oscillators varies like 26 degrees, 52 degrees, 78 degrees and so forth.

Since the phase difference between the oscillations generated by both the groups of the ultrasonic oscillators varies as stated above, the sinusoidal wave accordingly varies as time elapses. Hence, oscillation in every part of the matrix electrode 40 is increasingly uniform, compared with the prior art embodiments. Consequently, the toner in and around the toner holes 23 is well brought under control.

(4) Embodiment 4

Still another preferred embodiment of the present invention will be described with reference to FIG. 13.

Figure 13:
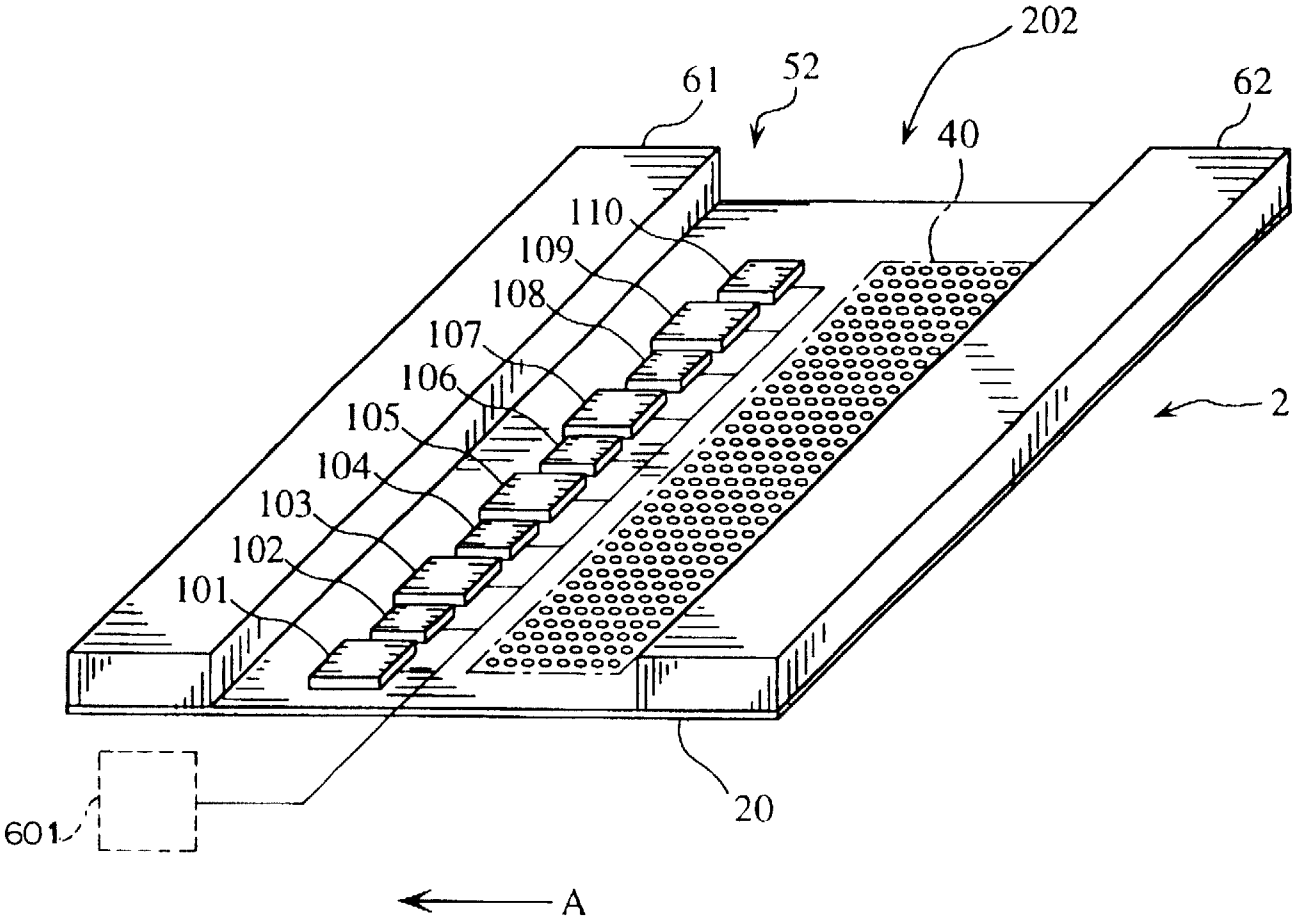
FIG. 13 is a schematic perspective view showing still another print head.

FIG. 13 depicts a print head 202. In FIG. 13 and FIG. 16, like reference numerals denote corresponding parts, and explanation about them is omitted.

In this print head 202, an ultrasonic oscillation generator 52 consists of a plurality of ultrasonic oscillators, 111 to 120, arranged in alignment and a controller 601 therefore. The odd-numbered ultrasonic oscillators, 111, 113, 115, 117 and 119, are classified into a first group while the even-numbered ultrasonic oscillators, 112, 114, 116, 118 and 120, are classified into a second group.

In the top plan view of the print head, the ultrasonic oscillators, 111 to 120, are all rectangular in shape. The ultrasonic oscillators in the first group are larger than those in the second group. This means a resonance frequency of the first group is smaller than that of the second group. The ultrasonic oscillators 111 to 120 are driven in the manner as mentioned below.

Sinusoidal a.c. voltage of frequency equivalent to the resonance frequency of the first group, e.g., 400 kHz is applied to the first group of the ultrasonic oscillators while the sinusoidal a.c. voltage of frequency equivalent to the resonance frequency of the second group, e.g., 430 KHz is applied to the second group of the ultrasonic oscillators. The ultrasonic oscillators of both the groups are simultaneously driven.

A difference of resonance frequency between both the groups of the ultrasonic oscillators preferably ranges approximately from 1% to 30% of the resonance frequency of one of the groups of the ultrasonic oscillators.

Such an arrangement causes the frequency of oscillation (resonance frequency) generated by the first group of the ultrasonic oscillators to be different from the frequency of oscillation (resonance frequency) generated by the second group of the ultrasonic oscillators. Thus, wavelengths of the oscillations generated by both the groups of the ultrasonic oscillators are different from each other. When the oscillations by the both groups of the ultrasonic oscillators are transmitted to an arbitrary point on the print head 202, a combination of a phase of the oscillation by the first group with a phase of the oscillation by the second group does not always keep constant. Thus, since a magnitude of oscillation in the arbitrary point on the print head 202 varies, oscillation in every part in the matrix electrode 40 becomes increasingly uniform, compared with the prior art embodiments. Consequently, the toner in and around the toner holes 23 is well brought under control.

(5) Embodiment 5

Further another preferred embodiment of the present invention will be described with reference to FIG. 13. A configuration of the print head 202 is equivalent to that in the Embodiment 4, and explanation about it is omitted.

As mentioned above, ultrasonic oscillators classified in a first group are larger than those in a second group in the print head 202 in this embodiment. This means a resonance frequency of the first group of the ultrasonic oscillators is smaller than that of the second group of the ultrasonic oscillators. The ultrasonic oscillators 111 to 120 are driven in a manner as stated below.

Figure 14:
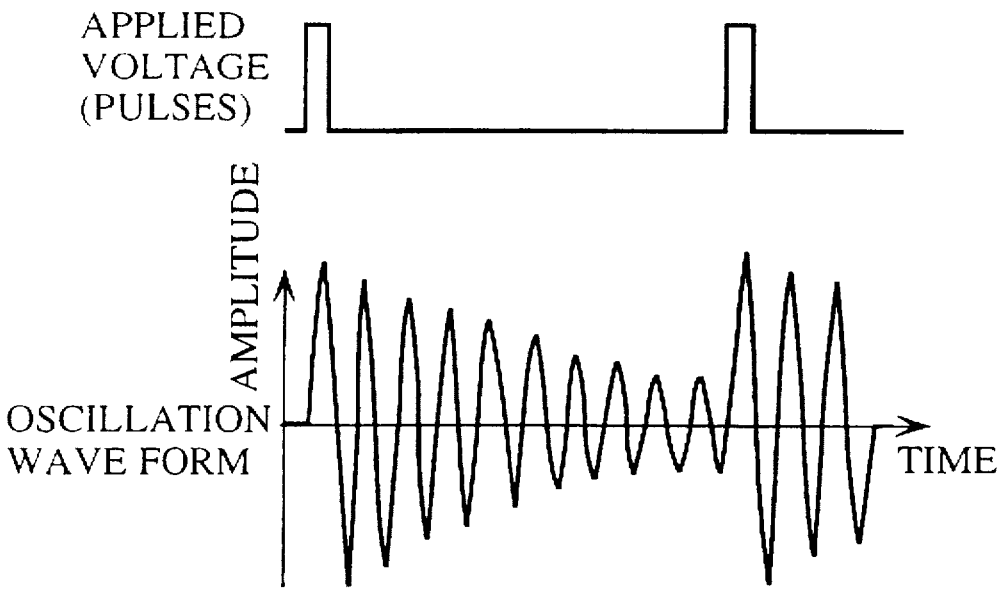
FIG. 14 is a waveform diagram illustrating the waveform of oscillation which is generated by an ultrasonic oscillator when pulse voltage is applied to the ultrasonic oscillator.
Figure 15:
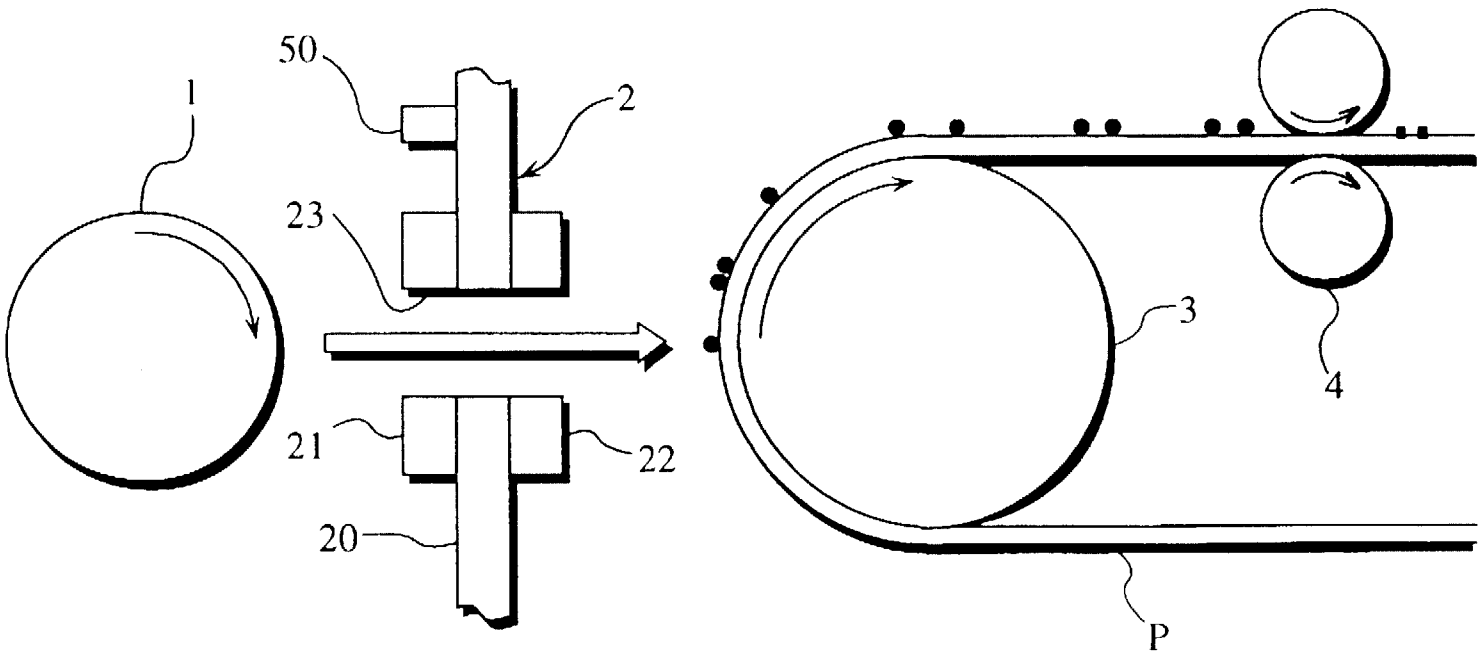
FIG. 15 (PRIOR ART)
FIG. 15 is a diagram showing a simplified arrangement of a power jet image forming apparatus.

Pulse voltage as illustrated in FIG. 14 is equivalently applied to the first and second groups of the ultrasonic oscillators. For example, a pulse width of the pulse voltage Vp may be 1 μs; pulse intervals may range from 10 μs to 100μs; a voltage level is 100V.

As shown in FIG. 14, applying the pulse voltage to the ultrasonic oscillators 111 to 120 causes oscillation of the resonance frequency of the ultrasonic oscillators. Assuming now that a side of each ultrasonic oscillator of the first group is 5 mm in length while a side of each ultrasonic oscillator of the second group is 4 mm, the first group of the ultrasonic oscillators oscillate at a frequency equivalent to their resonance frequency, e.g., at 400 kHz while the second group of the ultrasonic oscillators oscillate at a frequency equivalent to their resonance frequency, e.g., at 500 kHz.

Thus, wavelengths of the oscillations generated by both the groups of the ultrasonic oscillators are different from each other. When the oscillations by both the groups of the ultrasonic oscillators are transmitted to an arbitrary point on the print head 202, a combination of a phase of the oscillation by the first group of the ultrasonic oscillators with a phase of the oscillation by the second group does not always keep constant. Thus, since a magnitude of the oscillation in the arbitrary point on the print head 202 varies, oscillation in every part in the matrix electrode 40 becomes increasingly uniform, compared with the prior art embodiments. Consequently, the toner in and around the toner holes 23 is well brought under control. Although the ultrasonic oscillators constituting the ultrasonic oscillation generator are classified in two groups in the above explanation on Embodiments 2 to 5, they may be classified into three or more groups.

We claim:

1. A print head for a powder jet image forming apparatus in which the print head is disposable between a developer supply roller and a recording paper feed element of such image forming apparatus, the print head comprising:

an insulating layer having a first major surface and a second major surface, the insulating layer having a plurality of holes therethrough;

a plurality of first electrodes formed in the first major surface of the insulating layer, the first electrodes each having holes therethrough, and a plurality of second electrodes formed in the second major surface of the insulating layer, the second electrodes each having holes therethrough, the first electrodes and the second electrodes being oriented at an angle with respect to each other and, together with the insulating layer, constituting a matrix electrode, one of the holes of the first electrodes, one of the holes of the insulating layer, and one of the holes of the second electrodes being aligned to provide a hole through the matrix electrode for passing developer therethrough, a grid electrode generating a first electric field for controlling developer supply from a developer supply roller of an image forming apparatus and a second electric field for controlling developer supply from the grid electrode to the first electrodes of the matrix electrode, the grid electrode being located spaced apart from the first electrodes of the matrix electrode so that the first electrodes are located between the grid electrode and the insulating layer, the grid electrode being oriented parallel with the insulating layer, so that the second electric field is an uniform electric field, and the grid electrode having a plurality of apertures and a plurality of bridge electrodes, and wherein a plurality of unobstructed paths are provided, each of the paths passing through one of the holes of the insulating layer, one of the holes of the first electrodes, one of the holes of the second electrodes and one of the apertures of the grid electrode.

2. A print head according to claim 1, wherein the grid electrode has the bridge electrodes positioned opposed to the holes of the insulating layer, the holes of the first electrodes, and the holes of the second electrodes for passing developer.

3. A print head according to claim 1, wherein the print head uses a developer that is a two-component developer containing carrier having a first particle size and toner having a second particle size different from the first particle size, and wherein the apertures in the grid electrode have a size larger than the second particle size so as to pass the toner but smaller than the first particle size so as not to pass the carrier.

4. A print head according to claim 1, wherein the print head uses a developer that is a two-component developer containing carrier having a first particle size and toner having a second particle size different from the first particle size; and wherein the apertures are shaped as slits extending in a given direction, the slits have a width larger than a diameter of particles of the second particle size and smaller than a diameter of particles of the first particle size.

5. A print head according to claim 1, wherein a ratio of the total area of all the apertures to an area of a region where the apertures are formed in the grid electrode ranges from 30% to 70%.

6. A print head according to claim 1, wherein the grid electrode includes a metal plate having opposite sides and a plurality of slits of a specified width, on each of said sides, said slits being formed by etching said metal plate, a metal layer formed on one of said opposite sides of the metal plate by electrolytic plating or electroless plating, so that the slits are narrowed in width.

7. A powder jet image forming apparatus, comprising a print head which has a plurality of first electrodes and a plurality of second electrodes arranged as a matrix electrode which has an insulating layer interposed between the first electrodes and the second electrodes, the first electrodes and the second electrodes being oriented at an angle with respect to each other, the first electrodes, the second electrodes and the insulating layer each having holes that are aligned for passing developer through the matrix electrode, and an ultrasonic oscillation generator provided in the print head for causing ultrasonic oscillation in the print head, the ultrasonic oscillation generator including a plurality of ultrasonic oscillators, and a controller for controlling the ultrasonic oscillators, the ultrasonic oscillators being classified into two or more groups, and the controller controlling driving of the ultrasonic oscillators so that the oscillators so that the oscillators are driven in a predetermined order of the groups succeedingly from one group to another.

8. A powder jet image forming apparatus comprising a print head which has a plurality of first electrodes and a plurality of second electrodes arranged as a matrix electrode which has an insulating layer interposed between the first electrodes and the second electrodes, the first electrodes and the second electrodes being oriented at an angle with respect to each other, the first electrodes, the second electrodes and the insulating layer each having holes that are aligned for passing developer through the matrix electrode, and an ultrasonic oscillation generator provided in the print head for causing ultrasonic oscillation in the print head, the ultrasonic oscillation generator including a plurality of ultrasonic oscillators, and a controller for controlling the ultrasonic oscillators, the ultrasonic oscillators being classified into two or more groups, and the controller controlling driving of the ultrasonic oscillators so that the oscillators are driven in such a manner that a phase difference in drive voltage of one group of the ultrasonic oscillators from an other group thereof varies every specified period of time.

9. A powder jet image forming apparatus, comprising a print head which has a plurality of first electrodes and a plurality of second electrodes arranged as a matrix electrode which has an insulating layer interposed between the first electrodes and the second electrodes, the first electrodes and the second electrodes being oriented at an angle with respect to each other, the first electrodes, the second electrodes and the insulating layer each having holes that are aligned for passing developer through the matrix electrode, and an ultrasonic oscillation generator provided in the print head for causing ultrasonic oscillation in the print head, the ultrasonic oscillation generator including a plurality of ultrasonic oscillators, and a controller for controlling the ultrasonic oscillators, the ultrasonic oscillators including two or more ultrasonic oscillators having different resonance frequencies, the controller controlling the ultrasonic oscillators to cause the oscillators to oscillate at their respective resonance frequencies by applying, to the ultrasonic oscillators, voltages of frequencies corresponding to their respective resonance frequencies.

10. A powder jet image forming apparatus, comprising a print head which has a plurality of first electrodes and a plurality of second electrodes arranged as a matrix electrode which has an insulating layer interposed between the first electrodes and the second electrodes, the first electrodes and the second electrodes being oriented at an angle with respect to each other, the first electrodes, the second electrodes and the insulating layer each having holes for passing developer through the matrix electrode, and an ultrasonic oscillation generator provided in the print head for causing ultrasonic oscillation in the print head, the ultrasonic oscillation generator including a plurality of ultrasonic oscillators, and a controller for controlling the ultrasonic oscillators, the ultrasonic oscillators including two or more ultrasonic oscillators having different resonance frequencies, the controller controlling the ultrasonic oscillators to cause the oscillators to oscillate at their respective resonance frequencies by applying a same pulse voltage to the ultrasonic oscillators.

* * * * *